US008951024B2

(12) United States Patent
Ishii et al.

(10) Patent No.: US 8,951,024 B2
(45) Date of Patent: Feb. 10, 2015

(54) AIR BLOWER

(75) Inventors: Hikoya Ishii, Osaka (JP); Katsushi Morimoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 557 days.

(21) Appl. No.: 13/375,893

(22) PCT Filed: Apr. 7, 2010

(86) PCT No.: PCT/JP2010/056312
§ 371 (c)(1),
(2), (4) Date: Dec. 2, 2011

(87) PCT Pub. No.: WO2010/140424
PCT Pub. Date: Dec. 9, 2010

(65) Prior Publication Data

US 2012/0070320 A1 Mar. 22, 2012

(30) Foreign Application Priority Data

Jun. 4, 2009 (JP) ..... 2009-135304

(51) Int. Cl.
*F01D 25/00* (2006.01)
*F04B 23/00* (2006.01)
(Continued)

(52) U.S. Cl.
CPC ..... *F04D 29/703* (2013.01); *F04D 17/167* (2013.01); *F04D 29/329* (2013.01); *F04D 29/705* (2013.01)
USPC ..... 417/313; 416/146 R; 95/58; 96/74

(58) Field of Classification Search
CPC ... F04D 17/167; F04D 19/002; F04D 29/263; F04D 29/325; F04D 29/329; F04D 29/703; F04D 29/705
USPC ..... 417/313, 423.1; 416/146 R, 244 R, 416/247 R; 95/58; 96/74, 222; 261/87, 261/DIG. 88
See application file for complete search history.

(56) References Cited

U.S. PATENT DOCUMENTS 2,784,465 A * 3/1957 Strobel-Fuchs ..... 422/124
4,568,521 A * 2/1986 Spector ..... 422/124
(Continued)

FOREIGN PATENT DOCUMENTS

CN 1310793 A 8/2001
CN 101311545 A 11/2008
(Continued)

OTHER PUBLICATIONS

International Search Report issued in PCT/JP2010/056312, dated May 25, 2010.

*Primary Examiner* — Charles Freay
(74) *Attorney, Agent, or Firm* — Birch, Stewart, Kolasch & Birch, LLP

(57) ABSTRACT

An air blower includes a motor; a fan connected to an output shaft of the motor and rotatively driven by the motor; and a fan nut fixing the fan onto the output shaft of the motor, a diffusive substance is kept in the fan nut provided on the output shaft of the motor, and an ion generating unit is attached to a motor body concentrically with the output shaft. Therefore, the diffusive substance, positive ions and negative ions may be diffused without interrupting blowing and without harmfully affecting the air blowing function. Since the diffusive substance and the ion generating unit are provided inside a fan guard, an infant or the like may be prevented from touching them, and thus, the safety may be secured.

8 Claims, 12 Drawing Sheets

(51) Int. Cl.

| | |
|---|---|
| ***B03C 3/01*** | (2006.01) |
| ***F04D 29/70*** | (2006.01) |
| ***F04D 17/16*** | (2006.01) |
| ***F04D 29/32*** | (2006.01) |

(56) References Cited

U.S. PATENT DOCUMENTS 4,666,638 A * 5/1987 Baker et al. ..... 261/26
2011/0103982 A1* 5/2011 A. et al. ..... 417/423.9

FOREIGN PATENT DOCUMENTS

| | | | |
|---|---|---|---|
| JP | 62-188592 | U | 12/1987 |
| JP | 2-69095 | U | 5/1990 |
| JP | 9-245935 | A | 9/1997 |
| JP | 2004-242971 | A | 9/2004 |
| JP | 2007-32351 | A | 2/2007 |
| WO | WO 00/58669 | | 10/2000 |

* cited by examiner

AIR BLOWER

This application is the National Phase of PCT/JP2010/056312 filed on Apr. 7, 2010, which claims priority under 35 U.S.C. §119(a) to Patent Application No. 2009-135304 filed in Japan on Jun. 4, 2009, all of which are hereby expressly incorporated by reference into the present application.

BACKGROUND

1. Technical Field

The present invention relates to an air blower capable of diffusing a diffusive substance such as a pest control agent and/or ions.

2. Description of Related Art

Air blowers such as an electric fan having various functions in addition to an air blowing function to send air with a desired flow in a desired direction have been conventionally proposed (see, for example, Japanese Patent Application Laid-Open No. 9-245935 and Japanese Patent Application Laid-Open No. 2007-32351).

An air blower disclosed in Japanese Patent Application Laid-Open No. 9-245935 is additionally provided with a negative ion generating unit for generating negative ions. When the negative ion generating unit is provided, for example, in front of or behind the vicinity of a fan blade of an electric fan, that is, an air blower handy to carry, not only a cool breeze may be easily obtained but also beneficial physiological effects such as refreshment may be obtained at the same time owing to the negative ions.

A vaporizable substance diffusing apparatus for a fan disclosed in Japanese Patent Application Laid-Open No. 2007-32351 is capable of externally diffusing a vaporizable substance such as a pest control agent kept therein by utilizing an air flow caused by an electric fan. More specifically, the vaporizable substance diffusing apparatus for a fan includes an attaching tool having a circular ring part and a catching part movably attached to the ring part and capable of catching a fan guard of an electric fan; and a diffusion vessel having an engagement part to be engaged with the ring part and keeping a vaporizable substance therein.

When the ring part is engaged with the engaging part of the diffusion vessel and the catching part catches the fan guard of the electric fan in this vaporizable substance diffusing apparatus for a fan, the diffusion vessel may be attached to any of various electric funs in different sizes. Then, the vaporizable substance such as a pest control agent kept in the diffusion vessel is diffused in a living space in accordance with an air blow caused by the electric fan, and therefore, not only a cool breeze may be obtained but also mosquitoes may be exterminated at the same time.

SUMMARY

The vaporizable substance diffusing apparatus for a fan according to Japanese Patent Application Laid-Open No. 2007-32351 is, however, attached to the outside of the fan guard of the electric fan, and hence, it is apprehended that an infant or the like may touch the pest control agent, that is, a hazardous substance, and thus, there is a problem in the safety. Furthermore, when the diffusion vessel is disposed in an air flow path in front of the electric fan, there arises a problem, for example, that the air flow of the electric fan is reduced as well as noise is caused.

In the air blower of Japanese Patent Application Laid-Open No. 9-245935, although it is possible to obtain the beneficial physiological effects such as refreshment owing to the negative ions, there is no countermeasure against viruses such as avian influenza virus that is feared to spread through chickens. Furthermore, since the negative ion generating unit generates negative ions through discharge caused by applying a high voltage to negative and positive electrodes, when the unit is attached to the outside of an electric fan, it is apprehended that an infant or the like may touch the unit, and thus, there is a problem in the safety.

The present invention is devised in consideration of the aforementioned circumstances, and an object of the invention is providing an air blower capable of diffusing an diffusive substance such as a pest control agent and/or ions without harmfully affecting the air blowing function while securing safety.

The air blower of this invention includes a motor; a fan connected to an output shaft of the motor and rotatively driven by the motor; and a fixing member fixing the fan onto the output shaft of the motor, and the fixing member is capable of keeping a diffusive substance therein.

According to this invention, the diffusive substance may be kept in the fixing member used for fixing the fan onto the output shaft of the motor. Since the diffusive substance is kept in the fixing member provided on the output shaft of the motor, the diffusive substance such as a pest control agent may be diffused without interrupting an air flow path caused in accordance with rotation of the fan and without harmfully affecting the air blowing function. Furthermore, since a rotating part such as a fan of an air blower such as an electric fan is generally surrounded by a fan guard or the like, the diffusive substance is provided within the fan guard, and hence, an infant or the like may be prevented from touching it, and thus, safety may be secured.

In the air blower of the invention, the fixing member includes a storage space for storing the diffusive substance therein and is provided with through holes communicating inside and outside of the storage space with each other.

According to this invention, the fixing member includes the storage space for storing the diffusive substance therein, and the storage space is provided with the through holes communicating the inside and the outside of the storage space with each other. Therefore, the diffusive substance stored in the storage space is released to the outside of the storage space through the through holes provided in the fixing member and is diffused in a room owing to an air flow caused in accordance with the rotation of the fan. Since the diffusive substance is kept inside the fixing member, an infant or the like may be definitely prevented from touching it, and thus, the safety is secured. Since the through holes communicating the inside and the outside of the storage space with each other are provided in the fixing member, the diffusive substance such as a pest control agent may be efficiently released to the outside.

In the air blower of the invention, the storage space is in a cylindrical shape.

According to this invention, since the storage space is in a cylindrical shape, the diffusive substance stored in the storage space may be further more efficiently released to the outside by appropriately forming the through holes in the inner and outer circumferential walls of the cylindrical shape.

In the air blower of the invention, the fan is a propeller fan including a boss part externally fitted on the output shaft and blades provided on the boss part, and the fixing member has a contact projection projected toward the boss part and in contact with the boss part.

According to this invention, since the contact projection projected toward the boss part externally fitted on the output shaft and in contact with the boss part is provided on the fixing member, the storage space of the fixing member is disposed away from the fan correspondingly to the projecting length of the contact projection. Therefore, the diffusive substance may be easily released to the outside on the side of the fixing member closer to the motor, and hence, the diffusive substance may be further more efficiently released to the outside.

In the air blower of the invention, the fixing member is in a cylindrical shape, includes an engaging part to be engaged with the output shaft on one side along a shaft length direction and includes a removably provided cover part for opening/closing the storage space on the other side.

According to this invention, the fixing member in a cylindrical shape is fixed through engagement with the output shaft on one side along the shaft length direction and includes the removably provided cover part for opening/closing the storage space on the other side. Since the cover part for opening/closing the storage space is disposed on the opposite side to its portion fixed on the output shaft, the diffusive substance may be easily exchanged.

Alternatively, the air blower of the invention includes a motor; a fan rotatively driven by the motor; a fan guard surrounding and protecting the fan; and an ion generating unit generating positive ions and negative ions, and the ion generating unit is provided inside the fan guard between the motor and the fan.

According to this invention, the ion generating unit for generating positive ions and negative ions is provided between the motor and the fan rotatively driven by the motor inside the fan guard surrounding and protecting the fan. Since the ion generating unit to which a high voltage is applied is provided inside the fan guard, an infant or the like may be prevented from touching it, and hence the safety may be secured. Furthermore, since the ion generating unit is provided between the motor and the fan guard, an air flow path caused in accordance with the rotation of the fan is not interrupted, and the air blowing function is minimally harmfully affected. Then, viruses such as avian influenza virus may be killed or inactivated by the positive ions and the negative ions generated by the ion generating unit.

In the air blower of the invention, the ion generating unit also works as a fixing ring for fixing the fan guard onto the motor.

According to this invention, since the ion generating unit also works as the fixing ring for fixing the fan guard onto the motor, the aforementioned effects may be attained while suppressing the size increase of the air blower.

In the air blower of the invention, the ion generating unit includes a housing having an internal thread part in a portion thereof, the motor includes an engaging cylinder that is disposed on a side of the output shaft concentrically with the output shaft and has, on an outer circumference thereof, an engaging part to be engaged with the internal thread part, and the fan guard is held between the ion generating unit and the motor.

According to this invention, the fan guard is held between the ion generating unit and the motor by providing the internal thread part in a portion of the housing of the ion generating unit and by allowing the engaging part of the engaging cylinder provided on the motor to be engaged with the internal thread part. Thus, the aforementioned effects may be attained with a simple structure while suppressing the size increase of the air blower.

Alternatively, the air blower of the invention includes the fixing member of the invention; and the ion generating unit of the invention.

According to this invention, since the air blower includes the fixing member and the ion generating unit of the invention, pests such as mosquitoes may be exterminated by diffusing the diffusive substance such as a pest control agent as well as viruses such as avian influenza virus may be killed or inactivated by diffusing the positive ions and the negative ions without harmfully affecting the air blowing function while securing the safety.

According to the present invention, a diffusive substance such as a pest control agent and/or ions may be diffused without harmfully affecting the air blowing function while securing safety.

The above and further objects and features will more fully be apparent from the following detailed description with accompanying drawings.

DETAILED DESCRIPTION

The present invention will now be described in detail by exemplifying an electric fan as an air blower with reference to accompanying drawings illustrating embodiments thereof.

Embodiment 1

Figure 1:
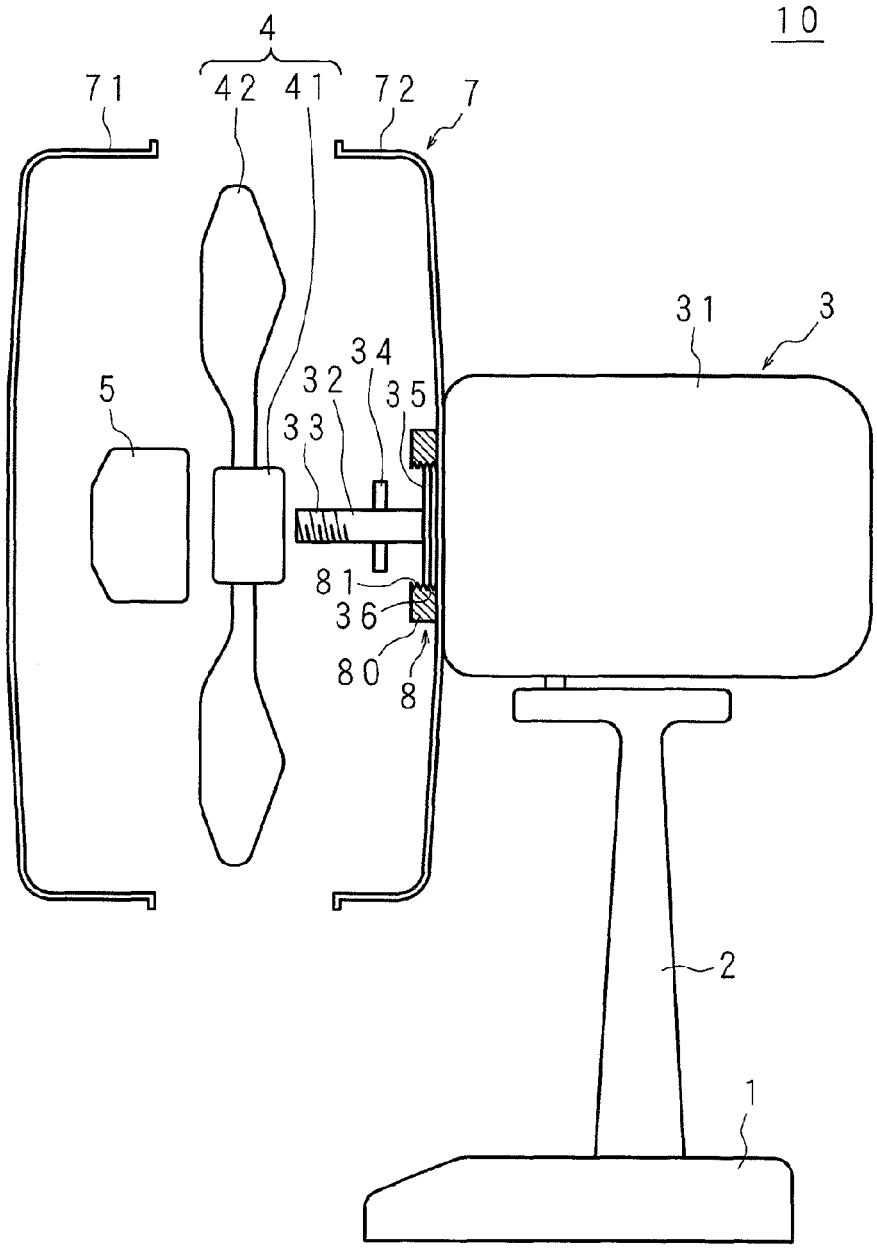
FIG. 1 is a schematic partially exploded view of an electric fan according to Embodiment 1.
Figure 2:
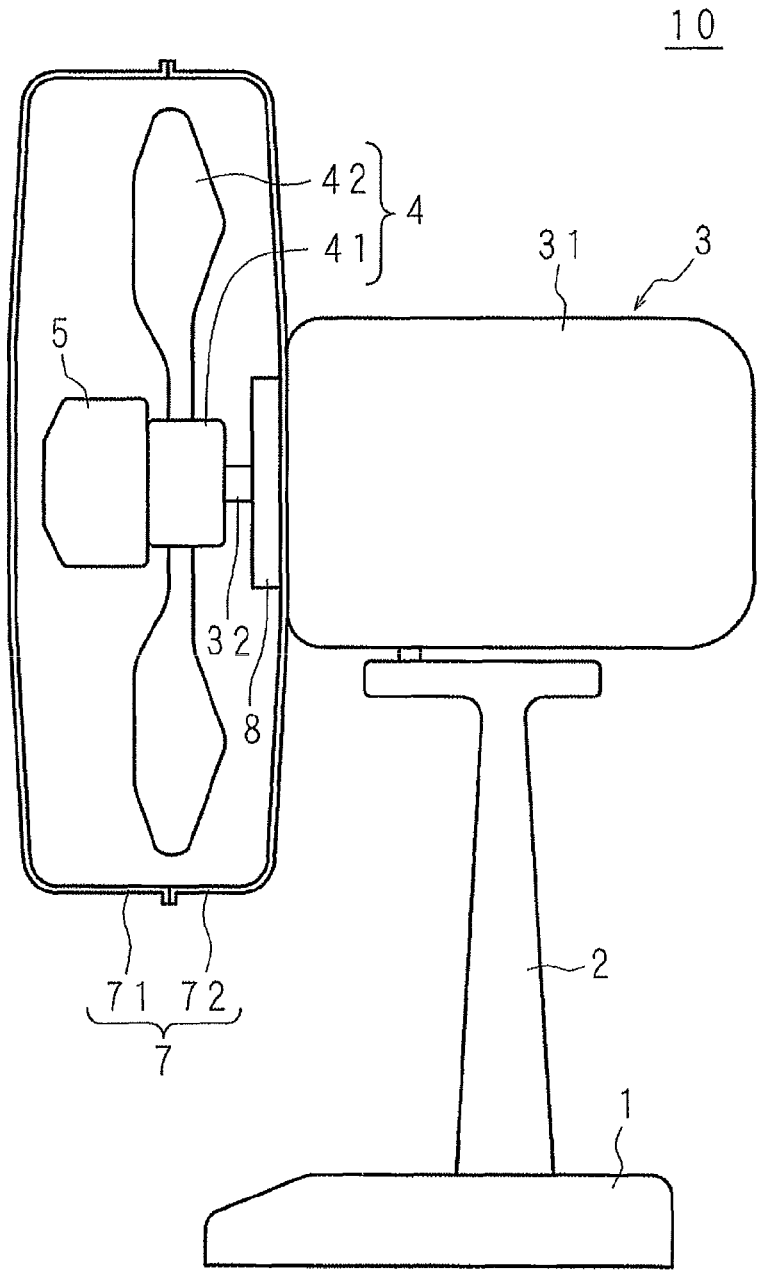
FIG. 2 is a schematic outline view of the electric fan according to Embodiment 1.

FIG. 1 is a schematic partially exploded view of an electric fan 10 according to Embodiment 1. FIG. 2 is a schematic outline view of the electric fan 10 of this embodiment.

In these drawings, a reference numeral 1 denotes a base, which is placed on a floor or the like and is provided with an operation panel (not shown) on its top face. A column 2 stands on the base 1. A motor 3 is provided on the upper end of the column 2. The motor 3 includes a motor body 31 in a substantially circular cylindrical shape and an output shaft 32 projecting from one side of the motor body 31. An external thread part 33 is provided on the tip of the output shaft 32. Furthermore, a fan boss check pin 34 is inserted into the output shaft 32 at right angles against the shaft length direction in a position appropriately away from the tip of the output shaft 32. Moreover, an engaging cylinder 35 is provided on a side of the motor body 31 closer to the output shaft 32 so as to be concentric with the output shaft 32. An external thread part 36 corresponding to an engaging part is formed on the outer circumference of the engaging cylinder 35. Incidentally, the engaging part provided on the outer circumference of the engaging cylinder 35 may be in any form as far as it may be engaged with an internal thread part of an ion generating unit 8 described later and it may be simply a projection projecting in the circumferential direction instead of an external thread.

The output shaft 32 of the motor 3 is provided with a fan 4 integrally rotated in accordance with the rotation of the output shaft 32. The fan 4 is a propeller fan including a cylindrical boss part 41 externally fitted on the output shaft 32 of the motor 3 and a plurality of blades 42 provided on the boss part 41 at equal intervals in the circumferential direction. The fan 4 is fixed on the output shaft 32 with a fan nut 5 corresponding to a fixing member in a cylindrical shape with the boss part 41 externally fitted on the output shaft 32 of the motor 3. Incidentally, the boss part 41 is provided with the fan boss check pin 34 for a whirlstop so as not to rotate relatively with the output shaft 32 and so as not to move toward the motor 3 in the shaft length direction of the output shaft 32.

Figure 3:
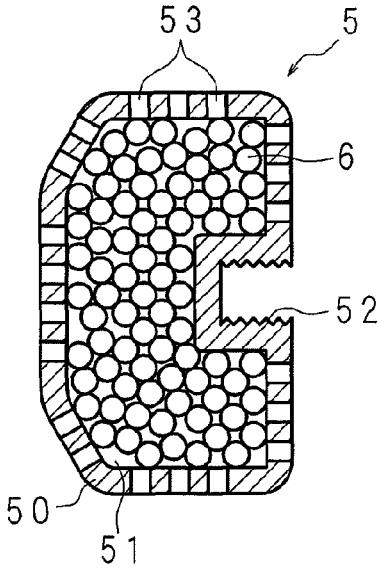
FIG. 3 is a schematic cross-sectional view of a fan nut.

FIG. 3 is a schematic cross-sectional view of the fan nut 5. The fan nut 5 also works as a hollow vessel for keeping a diffusive substance 6 therein, and includes a storage space 51 for storing the diffusive substance 6 inside a housing 50 in a closed-end cylindrical shape. On one side of the fan nut 5 along the shaft length direction, a recess concentric with the housing 50 and depressed toward the inside of the storage space 51 is formed, and an internal thread part 52 corresponding to an engaging part is formed on the inner wall of the recess. Furthermore, the fan nut 5 has a plurality of through holes 53 communicating the inside and the outside of the storage space 51 with each other. When this fan nut 5 is screwed with the internal thread part 52 on the external thread part 33 formed on the tip of the output shaft 32 of the motor 3, the fan 4 is fixed on the output shaft 32 of the motor 3 as illustrated in FIG. 2. The storage space 51 is filled with the diffusive substance 6 in the form of a plurality of particles as illustrated in FIG. 3. The diffusive substance 6 is, for example, an agent such as a pest control agent, a perfume or the like, and has a property to vaporize at room temperature to diffuse in the air. Then, the diffusive substance 6 having vaporized is released to the outside of the storage space 51 through the plural through holes 53 provided on the fan nut 5 for communicating the inside and the outside of the storage space 51 with each other.

The fan 4 attached in the aforementioned manner is provided with a fan guard 7 surrounding and protecting the fan 4. The fan guard 7 includes a fan guard front part 71 covering the fan 4 from the front side and a fan guard rear part 72 covering the fan 4 from the rear side and engaged with the fan guard front part 71.

Figure 4:
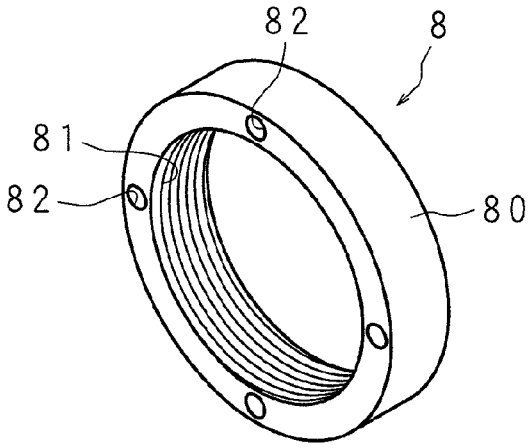
FIG. 4 is a schematic outline perspective view of an ion generating unit.

The fan guard 7 is fixed on the motor body 31 of the motor 3 with the ion generating unit 8 also working as a fixing ring. FIG. 4 is a schematic perspective outline view of the ion generating unit 8. The ion generating unit 8 includes a housing 80 in an external shape of a thick ring, and an internal thread part 81 formed on the inner circumferential face of the housing 80. Furthermore, a plurality of (specifically, four in FIG. 4) releasing holes 82 for releasing generated ions are provided on one side of the ion generating unit 8 at equal intervals in the circumferential direction.

Figure 5A:
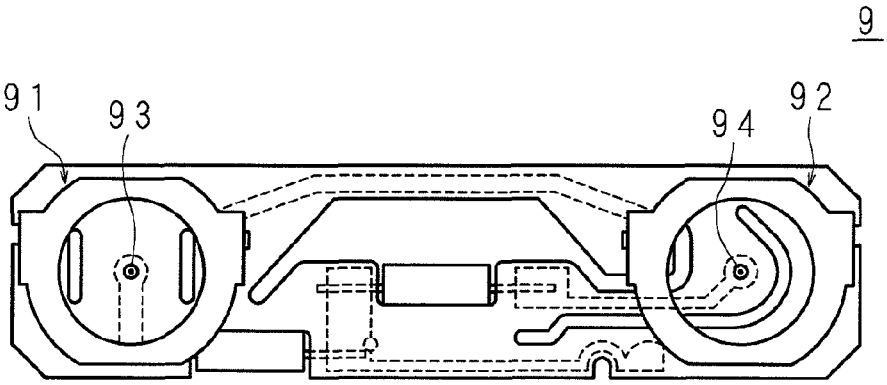
FIG. 5A is a diagram of an exemplified electrode structure for an ion generating unit main body.
Figure 5B:
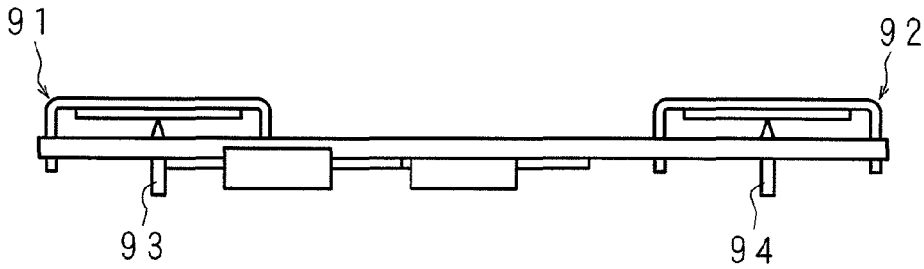
FIG. 5B is a diagram of the exemplified electrode structure for the ion generating unit main body.
Figure 6:
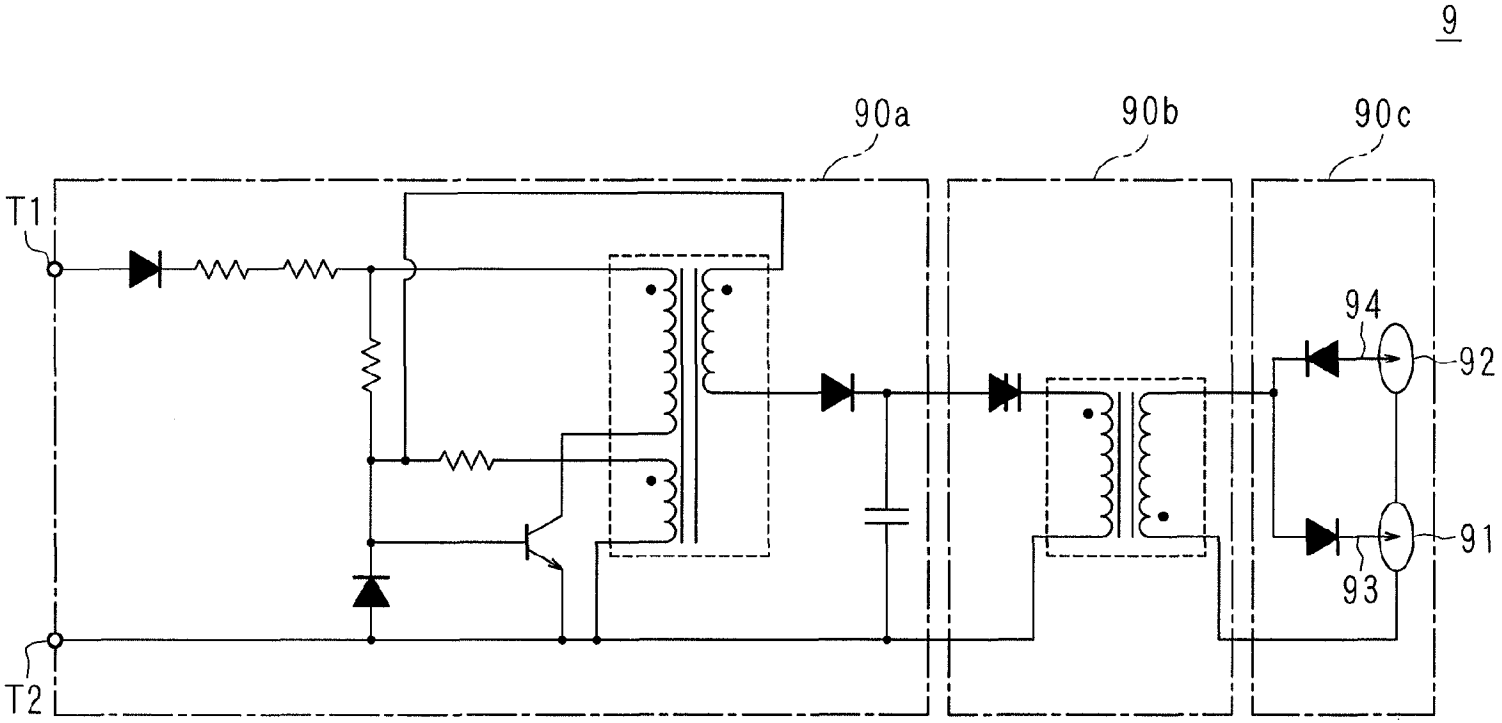
FIG. 6 is a diagram of an exemplified circuit for the ion generating unit main body.

An ion generating unit main body is provided inside the housing 80. FIGS. 5A and 5B illustrate an exemplified electrode structure for the ion generating unit main body, and specifically, FIG. 5A is a schematic plan view of an ion generating device and FIG. 5B is a schematic side view of the ion generating device. FIG. 6 illustrates an exemplified circuit for the ion generating unit main body.

FIGS. 5A, 5B and 6 illustrate an example of the ion generating unit main body 9 having what is called a cat-whisker type electrode structure. The ion generating unit main body 9 includes, as illustrated in FIG. 6, a first booster circuit 90*a* for boosting a DC voltage applied between a power input T1 and a ground input T2; a second booster circuit 90*b* for further boosting the voltage having been boosted by the first booster circuit 90*a*; and the ion generating device 90*c* for generating ions under application of the voltage having been boosted by the second booster circuit 90*b*. The ion generating device 90*c* includes, as illustrated in FIGS. 5A and 5B, discharge electrodes 93 and 94 in the form of a cat-whisker and induction electrodes 91 and 92 in the form of a plate electrode, and the discharge electrodes 93 and 94 are respectively provided inside through holes formed in the induction electrodes 91 and 92 concentrically with the through holes. In this ion generating unit main body 9, a high voltage obtained through boosting by the first booster circuit 90*a* and the second booster circuit 90*b* is applied between the discharge electrodes 93 and 94 and the induction electrodes 91 and 92 for causing discharge.

Figure 7A:
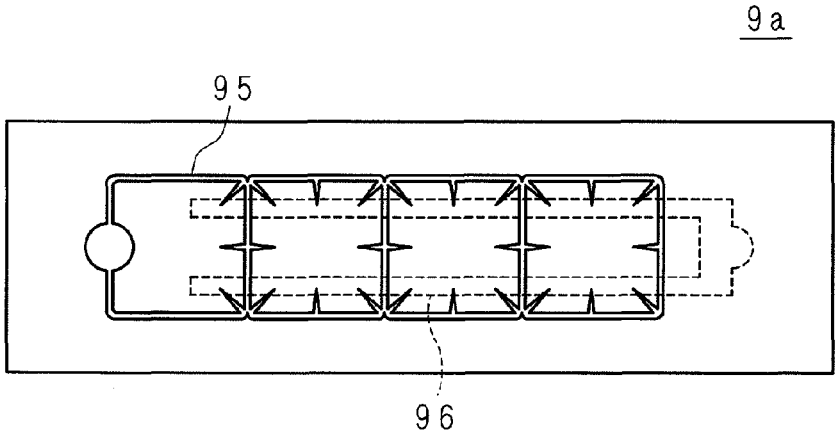
FIG. 7A is a diagram of another exemplified electrode structure for the ion generating unit main body.
Figure 7B:
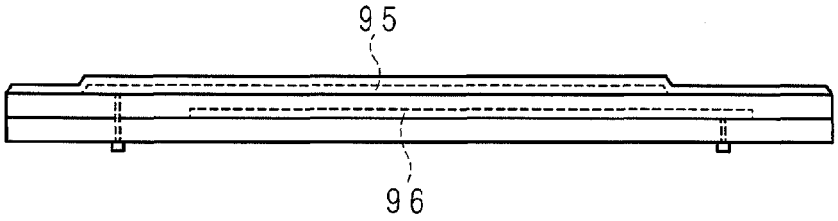
FIG. 7B is a diagram of another exemplified electrode structure for the ion generating unit main body.

FIGS. 7A and 7B illustrate another exemplified electrode structure for the ion generating unit main body, and specifically, they illustrate an example of an ion generating unit main body 9*a* having what is called a printed electrode structure. FIG. 7A is a schematic plan view of an ion generating device and FIG. 7B is a schematic side view of the ion generating device. The ion generating unit main body 9*a* includes, similarly to the ion generating unit main body 9, the ion generating device and a booster circuit (not shown) for applying a high voltage to the ion generating device. The ion generating device includes a discharge electrode 95 formed on an upper substrate by pattern printing and an induction electrode 96 formed between the upper substrate and a lower substrate by the pattern printing. In this ion generating unit main body 9*a*, a high voltage obtained through boosting by the booster circuit is applied between the discharge electrode 95 and the induction electrode 96 for causing discharge. It is noted that the electrode structures and the circuit configurations for these ion generating unit main bodies are known and hence are not herein described in detail.

Such an ion generating device generates, through ionization of moisture of the air, $H^+(H_2O)_n$ (wherein n is an arbitrary natural number) as positive ions and $O_2^-(H_2O)_m$ (wherein m is an arbitrary natural number) as negative ions. Then, through a chemical reaction caused between these ions, hydrogen peroxide ($H_2O_2$) and/or hydroxyl radicals (OH), that is, active species, are produced so as to remove suspended bacteria, suspended viruses and the like.

The fan guard 7 is positioned between the ion generating unit 8 having such an ion generating unit main body inside the housing 80 and the motor body 31, and the external thread part 36 provided on one side of the motor body 31 is screwed on the internal thread part 81 of the ion generating unit 8 with the side of the ion generating unit 8 opposite to the releasing holes 82 disposed on the side closer to the motor 3. Thus, the fan guard 7 is held between the motor body 31 and the ion generating unit 8 to be fixed on the motor 3 as illustrated in FIGS. 1 and 2.

In the electric fan 10 having the aforementioned structure, when an operation switch is turned on, power is supplied to the motor 3 so as to rotate the motor 3, and hence the output shaft 32 of the motor 3 is integrally rotated. In accordance with the rotation of the output shaft 32, the fan 4 fixed on the output shaft 32 with the boss part 41 by the fan nut 5 is integrally rotated, and this rotation of the fan 4 causes an air flow path from the fan guard rear part 72 toward the fan guard front part 71.

Furthermore, when the operation switch is turned on, power is supplied also to the ion generating unit 8 provided inside the fan guard rear part 72, and positive ions and negative ions are generated by the ion generating unit main body. The thus generated positive ions and negative ions are externally released through the release holes 82 of the ion generating unit 8, so as to diffuse in a room through the fan guard front part 71 owing to the air flow caused by the rotation of the fan 4.

On the other hand, the diffusive substance 6 kept inside the fan nut 5 is released to the outside of the storage space 51 through the plural through holes 53 formed in the fan nut 5 for communicating the inside and the outside of the storage space 51 with each other, and is ultimately diffused in the room through the fan guard front part 71 owing to the air flow caused by the rotation of the fan 4.

In this manner, the positive ions and the negative ions generated by the ion generating unit 8 attached inside the fan guard rear part 72 concentrically with the output shaft 32 of the motor 3 and the diffusive substance 6 such as a pest control agent diffused from the storage space 51 of the fan nut 5 provided on the output shaft 32 inside the fan guard 7 are diffused inside the room by the air flow caused by the rotation of the fan 4.

According to the electric fan 10 of Embodiment 1 having the aforementioned structure, viruses such as avian influenza virus and pathogenic bacteria may be killed or inactivated by the positive ions and the negative ions, and hence, human bodies may be protected from the viruses and pathogenic bacteria. In addition, pests such as mosquitoes that may be a vector of dengue fever may be eliminated by the diffusive substance 6.

Furthermore, since the diffusive substance 6 is kept in the fan nut 5 provided on the output shaft 32 of the motor 3 and the ion generating unit 8 is attached to the motor body 31 concentrically with the output shaft 32, they do not interrupt the air flow caused in accordance with the rotation of the fan 4, and thus, the diffusive substance 6, the positive ions and the negative ions may be diffused without harmfully affecting the air blowing function of the electric fan 10. Moreover, since the diffusive substance 6 and the ion generating unit 8 to which a high voltage is applied are disposed inside the fan guard 7, it is possible to prevent an infant or the like from touching the diffusive substance 6 and the ion generating unit 8, and thus, the safety may be secured.

In addition, the through holes 53 of the fan nut 5 communicating the inside and the outside of the storage space 51 where the diffusive substance 6 is stored are provided in the housing 50 of the fan nut 5, and hence, the diffusive substance 6 may be efficiently released to the outside.

Furthermore, the fan guard 7 is held between the motor body 31 and the ion generating unit 8 fixed on the motor 3 by screwing the external thread part 36 provided on one side of the motor body 31 on the internal thread part 81 of the ion generating unit 8, and the ion generating unit 8 also works as the fixing ring for fixing the fan guard 7 onto the motor 3, and therefore, the size increase of the electric fan 10 may be suppressed by employing a simple structure.

Embodiment 2

Figure 8:
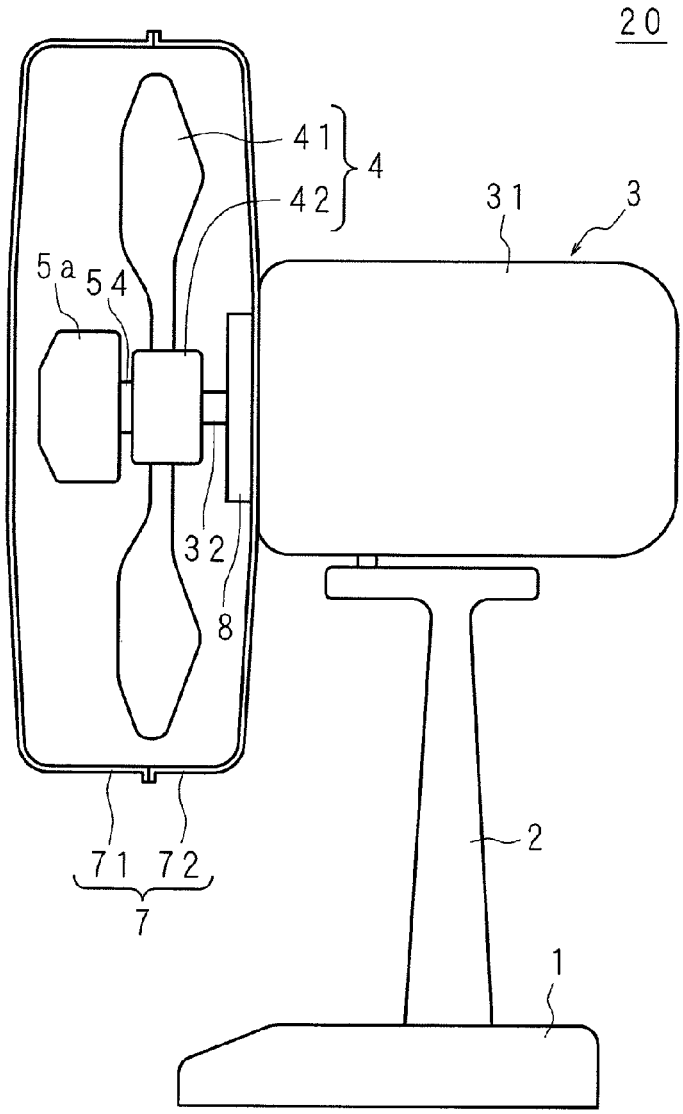
FIG. 8 is a schematic outline view of an electric fan according to Embodiment 2.
Figure 9:
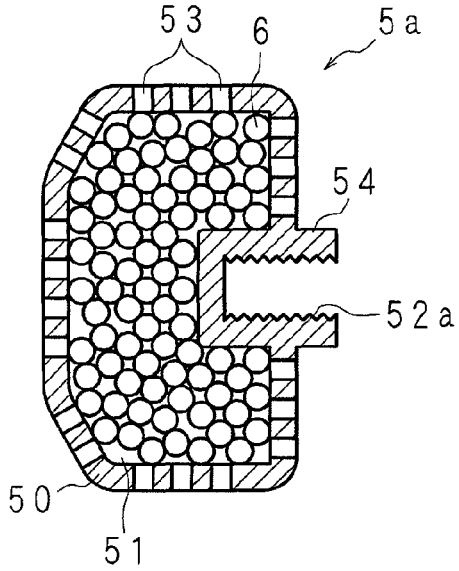
FIG. 9 is a schematic cross-sectional view of a fan nut.

FIG. 8 is a schematic outline view of an electric fan 20 according to Embodiment 2. The electric fan 20 of Embodiment 2 is different from the electric fan 10 of Embodiment 1 in the shape of the fan nut alone. FIG. 9 is a schematic cross-sectional view of a fan nut 5*a*.

The fan nut 5*a* also works as a hollow vessel for keeping a diffusive substance 6 therein, and includes a storage space 51 for storing the diffusive substance 6 inside a housing 50 in a closed-end cylindrical shape. On one side in the shaft length direction of the fan nut 5*a*, a recess concentric with the housing 50 and depressed toward the inside of the storage space 51 is formed, and an internal thread part 52*a* corresponding to an engaging part is formed on the inner circumferential wall of the recess. A contact projection 54 in a circular cylindrical shape having the same inner diameter as the recess is formed to stand concentrically with the recess on one side in the shaft length direction of the fan nut 5*a*. It is noted that the internal thread part 52*a* is also formed on the inner circumferential wall of the contact projection 54.

The fan nut 5*a* is screwed with the internal thread part 52*a* on an external thread part 33 formed on the tip of an output shaft 32 of a motor 3, so that a fan 4 may be fixed on the output shaft 32 of the motor 3. At this point, the contact projection 54 of the fan nut 5*a* is in contact with a boss part 42 of the fan 4 as illustrated in FIG. 8. The other structure is the same as that of Embodiment 1 illustrated in FIGS. 2 and 3, and hence, the same reference numerals as those used in FIGS. 2 and 3 are used to refer to corresponding elements so as to omit the detailed description of the structure.

In the electric fan 20 of Embodiment 2 having the aforementioned structure, since the storage space 51 of the fan nut 5*a* is provided to be away from the fan 4 correspondingly to the projecting length of the contact projection 54, the diffusive substance 6 may be easily released to the outside also on a side of the fan nut 5*a* closer to the motor 3, and hence, the diffusive substance 6 may be more efficiently released to the outside.

Figure 10:
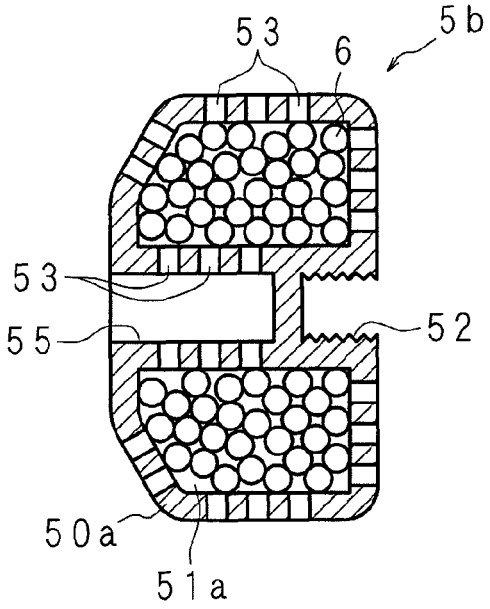
FIG. 10 is a schematic cross-sectional view of another example of the fan nut.

The shape of the fan nut is not limited to those described in Embodiments 1 and 2, but the fan nut may be in any shape as far as the diffusive substance stored in the storage space of the fan nut may be easily released to the outside. FIG. 10 is a schematic cross-sectional view of another example of the fan nut.

A fan nut 5*b* also works as a hollow vessel for keeping a diffusive substance 6 therein, and includes a storage space 51*a* for storing the diffusive substance 6 inside a housing 50*a* in a circular cylindrical external shape. The housing 50*a* has a circular cylindrical recess 55 concentric with the housing 50*a* on the other side of an internal thread part 52. A plurality of through holes 53 communicating the inside and the outside of the storage space 51*a* with each other are formed on the inner circumferential wall of the recess 55. The diffusive substance 6 is stored inside the storage space 51*a* formed by the thus concentrically provided circular cylinder and outer cylinder, and the diffusive substance 6 having vaporized is released to the outside not only through the outer circumference of the fan nut 5*b* but also through the inner circumferential wall of the recess 55. The other structure is the same as that of Embodiment 1 illustrated in FIG. 3, and hence, the same reference numeral as those used in FIG. 3 are used to refer to corresponding elements so as to omit the detailed description of the structure.

In an electric fan including the fan nut 5*b* in the aforementioned structure, since the through holes 53 are formed also on the inner circumferential wall of the recess 55 of the housing 50*a*, the diffusive substance 6 stored in the storage space 51*a* may be further more efficiently released to the outside.

Figure 11:
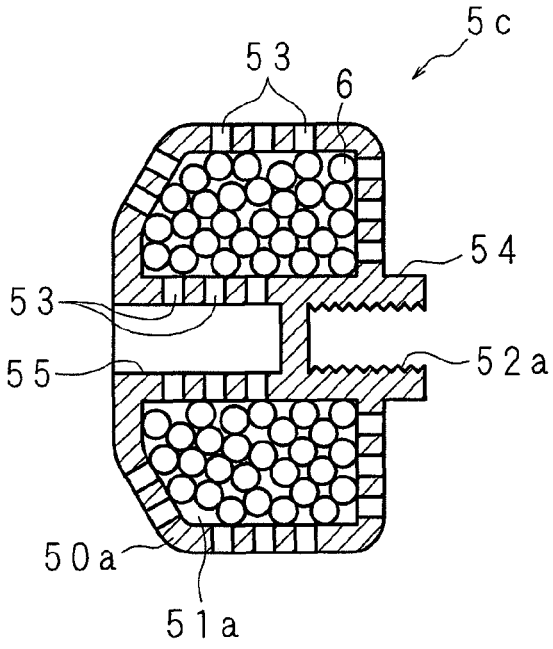
FIG. 11 is a schematic cross-sectional view of still another example of the fan nut.

FIG. 11 is a schematic cross-sectional view of still another example of the fan nut. A fan nut 5*c* of FIG. 11 is obtained by providing a contact projection 54 on one side in the shaft length direction of the fan nut 5*b* of FIG. 10. The other structure is the same as that of the fan nut illustrated in FIG. 10, and hence, the same reference numerals as those used in FIG. 10 are used to refer to corresponding elements so as to omit the detailed description of the structure.

In an electric fan including the fan nut 5*c* in the aforementioned structure, a storage space 51*a* of the fan nut 5*c* is away from a fan 4 correspondingly to the projecting length of the contact projection 54, and hence, a diffusive substance 6 may be easily released to the outside on a side of the fan nut 5*c* closer to a motor 3. Furthermore, since through holes 53 are formed on the inner circumferential wall of a recess 55 of a housing 50*a*, the diffusive substance 6 may be released to the outside through the inner circumferential wall of the recess 55. As a result, the diffusive substance 6 may be further more efficiently released to the outside.

Figure 12:
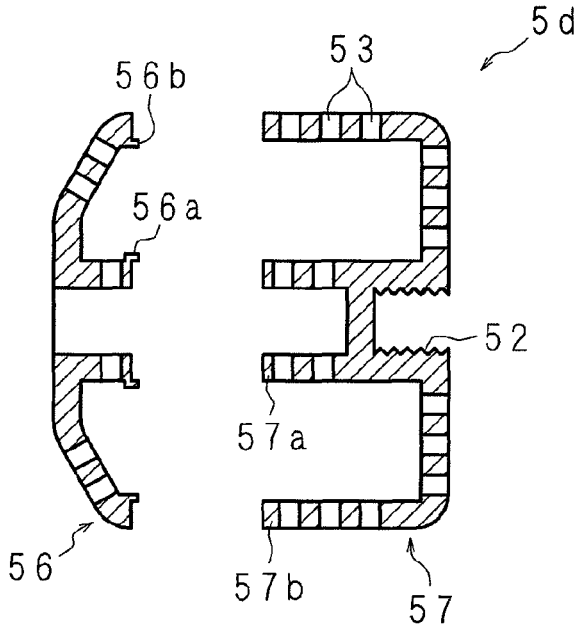
FIG. 12 is a schematic cross-sectional view of still another example of the fan nut.

FIG. 12 is a schematic cross-sectional view of still another example of the fan nut. A fan nut 5*d* of FIG. 12 is obtained by making the fan nut 5*b* of FIG. 10 separable. The fan nut 5*d* includes a cover part 56 for opening/closing a storage space and a housing main body 57 forming the storage space. In the fan nut 5*d*, the cover part 56 and the housing main body 57 are integrated removably from each other through engagement of a tip portion 57*a* of an inner cylinder of the housing main body 57 with an engaging cylinder 56*a* of an inner cylinder of the cover part 56 and engagement of a tip portion 57*b* of an outer cylinder of the housing main body 57 with an engaging cylinder 56*b* of an outer cylinder of the cover part 56. The other structure is the same as that of the fan nut illustrated in FIG. 10, and hence, the same reference numerals as those used in FIG. 10 are used to refer to corresponding elements so as to omit the detailed description of the structure. Incidentally, the engaging cylinders 56*a* and 56*b* are provided in the inner cylinder and the outer cylinder of the cover part 56 in this embodiment, which does not limit the invention, and any engaging part that may be engaged with the tip portions 57*a* and 57*b* of the inner cylinder and the outer cylinder of the housing main body 57 may be provided. For example, a projection projecting in the shaft length direction of the fan nut 5*d* may be provided.

In an electric fan including such a fan nut 5*d*, since the cover part 56 for opening/closing the storage space is provided on the other side of an internal thread part 52 corresponding to the engaging part to be engaged with an output shaft 32 of a motor 3, when the fan guard front part 71 is removed and the cover part 56 is removed, the diffusive substance 6 may be easily added or exchanged.

Since each of the fan nuts 5, 5*a*, 5*b*, 5*c* and 5*d* described above is fixed on the output shaft 32 of the motor 3 by screwing, it may be easily removed from the output shaft 32 by taking the fan guard front part 71 away and rotating the fan nut 5, 5*a*, 5*b*, 5*c* or 5*d*. When a plurality of fan nuts filled with different agents, perfumes and the like are prepared, it is possible to easily deal with different situations or enjoy different fragrances by merely exchanging the fan nut. Furthermore, when the inside of a fan nut is divided into a plurality of spaces with an agent, a perfume or a blended agent/perfume kept in each space, a fragrance and an effect of the agent may be simultaneously obtained, and thus, a room space may be staged so as to please every person.

Although the external shape of the fan nut is a circular cylindrical shape in each of the aforementioned embodiments, it may be any tubular shape and may be a polygonal prism.

Furthermore, a plurality of through holes are provided in the housing of the fan nut in each of the embodiments, which does not limit the invention, and any material and shape that do not prevent the release of the diffusive substance kept therein may be employed. For example, the housing may be made of a mesh material.

Moreover, the ion generating unit 8 works also as the fixing ring for fixing the fan guard 7 onto the motor 3 in each of the embodiments, which does not limit the invention. The object of the invention may be attained by employing a structure where the ion generating unit is simply held between the fan guard and the fixing ring to be fixed together or a structure where the ion generating unit is directly attached to the fan guard.

Furthermore, although an electric fan that may be placed on a floor or a table is exemplarily described as the air blower in the aforementioned embodiments, the present invention is applicable to any of other electric fans such as a ceiling fan and any of various air blowers such as a circulator. It goes without saying that the present invention may be practiced with various changes and modifications made without departing from the scope of the appended claims.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. An air blower comprising:

a motor;

a fan rotatively driven by the motor;

a fan guard surrounding and protecting the fan; and an ion generating unit generating positive ions and negative ions;

wherein the ion generating unit is provided inside the fan guard between the motor and the fan.

2. The air blower according to claim 1, wherein the ion generating unit also works as a fixing ring for fixing the fan guard onto the motor.

3. The air blower according to claim 2, wherein the ion generating unit includes a housing having an internal thread part in a portion thereof, the motor includes an engaging cylinder that is disposed on a side of the output shaft concentrically with the output shaft and has, on an outer circumference thereof, an engaging part to be engaged with the internal thread part, and the fan guard is held between the ion generating unit and the motor.

4. The air blower according to claim 1, wherein the fan is connected to an output shaft of the motor, further comprising a fixing member fixing the fan onto the output shaft of the motor, wherein the fixing member is capable of keeping a diffusive substance therein.

5. The air blower according to claim 4, wherein the fixing member includes a storage space for storing the diffusive substance therein and is provided with through holes communicating inside and outside of the storage space with each other.

6. The air blower according to claim 5, wherein the storage space is in a cylindrical shape.

7. The air blower according to claim 4, wherein the fan is a propeller fan including a boss part externally fitted on the output shaft and blades provided on the boss part, and the fixing member has a contact projection projected toward the boss part and in contact with the boss part.

8. The air blower according to claim 5, wherein the fixing member is in a cylindrical shape, includes an engaging part to be engaged with the output shaft on one side along a shaft length direction and includes a removably provided cover part for opening/closing the storage space on the other side.

* * * * *